US006054912A

United States Patent [19]

Kaneko et al.

[11] Patent Number: 6,054,912

[45] Date of Patent: Apr. 25, 2000

[54] TRIP DEVICE OF CIRCUIT BREAKER

[75] Inventors: Shozo Kaneko, Izumi; Takeshi Yura, Habikino, both of Japan

[73] Assignees: Terasaki Denki Sangyo Kabushiki Kaisha, Osaka, Japan; Moeller GmbH, Bonn, Germany

[21] Appl. No.: 09/371,497

[22] Filed: Aug. 10, 1999

[30] Foreign Application Priority Data

Aug. 14, 1998 [JP] Japan ..... 10-229589

[51] Int. Cl.[7] ..... H01H 9/00

[52] U.S. Cl. ..... 335/172; 335/167; 335/35

[58] Field of Search ..... 335/23, 35, 38, 335/167–176

[56] References Cited

U.S. PATENT DOCUMENTS

| | | | |
|---|---|---|---|
| 3,548,358 | 12/1970 | Klein | 335/16 |
| 5,467,069 | 11/1995 | Payet-Burin et al. | 335/42 |
| 5,469,121 | 11/1995 | Payet-Burin | 335/16 |

FOREIGN PATENT DOCUMENTS 3-101023 4/1991 Japan .

*Primary Examiner*—Lincoln Donovan
*Assistant Examiner*—Tuyên Nguyên

[57] ABSTRACT

A trip device of a main circuit breaker is provided which causes only a branch circuit breaker to be set into a tripped state when an abnormal current occurs at a load of the branch circuit breaker while keeping a closed state of the main circuit breaker. The trip device of the circuit breaker has a structure including a trip latch mechanism for opening switching contacts, a stationary core, a movable core which is attracted to the stationary core to release the latch mechanism of a trip lever, an operating pin for interrupting movement of the movable core while the movable core is attracted, an operating spring charged with force when the movable core is attracted, and an inertia roller holding the operating pin, kicked when the operating spring discharges the force, and moved to a position which does not interrupt movement of the movable core. Accordingly, this structure allows a selective tripping system to be implemented simply with small size and low cost.

5 Claims, 5 Drawing Sheets

TRIP DEVICE OF CIRCUIT BREAKER

BACKGROUND OF THE INVENTION

1. Field of the Invention

The present invention relates to a trip device of a main circuit breaker employed in a selective tripping system in an electric circuit constituted of the main circuit breaker connected to the power supply of the circuit and a branch circuit breaker connected to a load thereof. The selective tripping system causes only the branch circuit breaker to reach a tripped state when a short circuit leading to flow of a large amount of current happens in the load circuit connected to the branch circuit breaker.

2. Description of the Background Art

An electric circuit is generally configured of a main circuit breaker B1 connected to power supply S, a plurality of branch circuit breakers B2, B3 and B4 connected to the main circuit breaker B1 in parallel with each other, and load equipments L2, L3 and L4 controlled and protected by the branch circuit breakers as shown in FIG. 7. These circuit breakers usually have instantaneous trip devices respectively. When an enormous abnormal current such as short-circuit current flows, the instantaneous trip devices trip to open respective switching contacts and thus break the abnormal current.

In such an electric circuit, if a short-circuit accident occurs at a point X1 between main circuit breaker B1 and the branch circuit breakers, only the instantaneous trip device of main circuit breaker B1 operates to instantaneously break the abnormal current. As a result, main circuit breaker B1 reaches a tripped state so that feeding of electric power to all branch circuits is inevitably stopped.

If a short-circuit accident occurs at a point X2 on the side of the load connected to branch circuit breaker B2, for example, the short-circuit current flows through main circuit breaker B1 and branch circuit breaker B2. Consequently, not only branch circuit breaker B2 but also main circuit breaker B1 is set into the tripped state. Feeding of electric power to branch circuit breakers B3 and B4 where no accident occurs is accordingly stopped to interrupt the operations of load equipments L3 and L4.

An accident in one branch circuit thus interrupts an operation of a load equipment connected to another normal branch circuit. Such a state should generally be avoided as much as possible. For this reason, the selective tripping system is employed in order to keep supply of electric power to branch circuit breakers B3 and B4 by causing only branch circuit breaker B2 to trip if an accident happens at point X2 shown in FIG. 7.

Regarding the selective tripping system, an improvement in a conventional scheme is disclosed (for example, in Japanese Patent Laying-Open No.3-101023). A main circuit breaker B1 used in the conventional scheme has a short-time tripping device instead of the instantaneous trip device to prevent main circuit breaker B1 from tripping for a short period of time during which a branch circuit breaker B2 breaks the abnormal current when an accident occurs at point X2. Such a circuit configuration can endure the abnormal current at point X1 shown in FIG. 7 for a short period of time as described above.

In main circuit breaker B1 of the conventional selective tripping system, the operating time of the short-time tripping device should be made as short as possible in order to break the abnormal current at point X1 as soon as possible. In order to meet this requirement, an electronic trip device having a relatively constant operating time is employed as the shorttime tripping device. However, a problem of the electronic trip device is the high cost and large size of the device.

SUMMARY OF THE INVENTION

An object of the present invention is to provide a low cost and smallsized trip device of a main circuit breaker that can realize the selective tripping system.

According to one aspect of the invention, a trip device of a circuit breaker is provided. The circuit breaker has an operating mechanism for closing and opening switching contacts, and a trip latch which works the operating mechanism when released to open the switching contacts. The trip device includes a stationary core, and a movable core which is attracted to the stationary core when the current flowing through the circuit exceeds a predetermined threshold to release the trip latch. The trip device further includes an operating member which has engagement means for engagement with the movable core and is moved via the engagement means when the movable core is attracted, stopper means for interrupting the movement of the operating member while the movable core is attracted in order to prevent the trip latch from being released, an operating spring which is charged with force when the movable core is attracted and discharges the force when the movable core is returned to move the operating member with the discharged force, and a returning spring for biasing the operating member, which is moved when the operating spring discharges the force, in a direction of its original position. When the current flowing through the circuit decreases, the operating spring discharges the force to move by the use of the discharged force the operating member, which is prevented from moving by the stopper means, to a position which does not allow engagement of the engagement means with the movable core which is attracted again when the current again exceeds the threshold.

In such an arrangement, when the current flowing through the circuit first exceeds the threshold, the movable core charges the operating spring with force to move the operating member via the engagement means while attracted halfway. However, movement of the operating member is interrupted by the stopper means, and accordingly the movable core is not attracted to the position which allows the trip latch to be released. In this state, if the current decreases and the attracting force between the movable core and the stationary core decreases, the charged operating spring discharges the force to move the operating member in a direction opposite to that when the movable core is attracted.

By the time when the operating member moved by discharging of the operating spring is returned to its original position by the action of the returning spring, except when the value of the current again exceeds the threshold to cause the movable core to be attracted again, the movable core is not engaged with the engagement means and accordingly moves by a sufficient distance without influence of the stopper means in order to release the trip latch and allow the circuit breaker to attain the tripped state. Accordingly, the trip device does not operate when the circuit current exceeds the threshold for the first time and operates when the current exceeds it for the second time.

According to another aspect of the invention, the operating member of the trip device of the circuit breaker in the one aspect of the invention described above is a pivotably supported roller having inertial moment. By employing the roller having the inertial moment, the returning of the operating member rotated to move by discharging the operating spring can be delayed with a simple structure.

In the trip device of the circuit breaker according to the another aspect of the invention, the engagement means is desirably a pin which is eccentrically placed at the roller.

In the trip device of the circuit breaker according to the one aspect of the invention, desirably the movable core is shaped as a hinge and an operation setting spring is provided to bias the movable core in a direction away from the stationary core. As a result, setting of an operating condition of the operating member by the operating spring and setting of an operating threshold of the movable core by the operation setting spring can separately be made precisely.

The trip device of the circuit breaker according to the one aspect of the invention is desirably applied to an electromagnetic repulsion type circuit breaker in which the electromagnetic force produced by the current flowing through the switching contacts causes the switching contacts to repel with each other, and vanishing or reduction of the electromagnetic force causes the switching contacts to be brought into contact again.

In such an arrangement, when current which firstly exceeds the threshold flows, the current immediately decreases greatly. There exists a sufficient interval until the opened switching contacts are again in contact and the current secondarily exceeds the threshold. Therefore, precise adjustment of the threshold of the current which causes attraction of the movable core is unnecessary.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is hereinafter described in conjunction with FIGS. 1 to 4 illustrating an electromagnetic repulsion type circuit breaker provided with a trip device of the embodiment.

Figure 1:
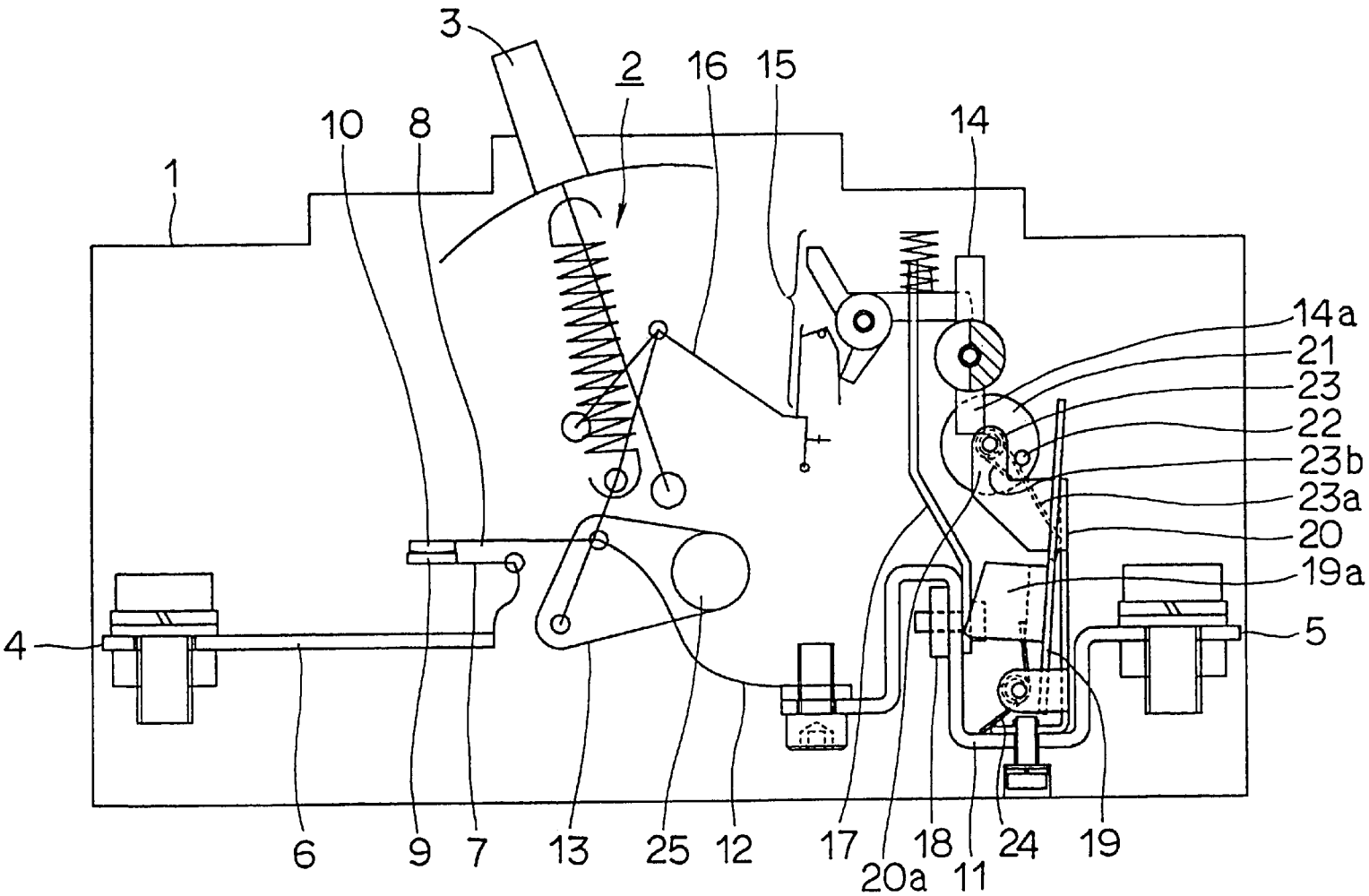
FIG. 1 is a side view of a trip device in a closed state according to an embodiment of the invention which is applied to an electromagnetic repulsion type circuit breaker.

Referring to FIG. 1, in the electromagnetic repulsion type circuit breaker of the embodiment, in a closed state, a case 1 formed of an insulating molding houses a main circuit conductive portion, an operating mechanism 2 having a toggle link mechanism for opening and closing switching contacts of the main circuit conductive portion, and a trip device which works the operating mechanism when an overcurrent flows for opening the switching contacts. A handle 3 for working operating mechanism 2 projects from case 1. The main circuit conductive portion and the operating mechanism of this embodiment are similar to those generally employed in the electromagnetic repulsion type circuit breaker.

Specifically, the main circuit conductive portion includes a stationary conductor 6 placed between an input side terminal 4 and an output side terminal 5, a repulsion contact 7 which is rotatably held and biased clockwise by a spring (not shown) and has one end connected to stationary conductor 6, a movable contact 8 arranged so that it faces repulsion contact 7, switching contacts 9 and 10 provided respectively to repulsion contact 7 and movable contact 8, a trip conductor 11, and a flexible conductor 12 which connects movable contact 8 with trip conductor 11.

In such a structure of the main circuit conductive portion, if an accident such as the short circuit occurs, an electromagnetic repulsion force is generated between repulsion contact 7 and movable contact 8 arranged to allow an abnormal current to flow in the reverse direction, and the repulsion force rotates repulsion contact 7 anti-clockwise at high speed to open switching contacts 9 and 10. As a result, the abnormal current is broken in an extremely short period of time.

Figure 4:
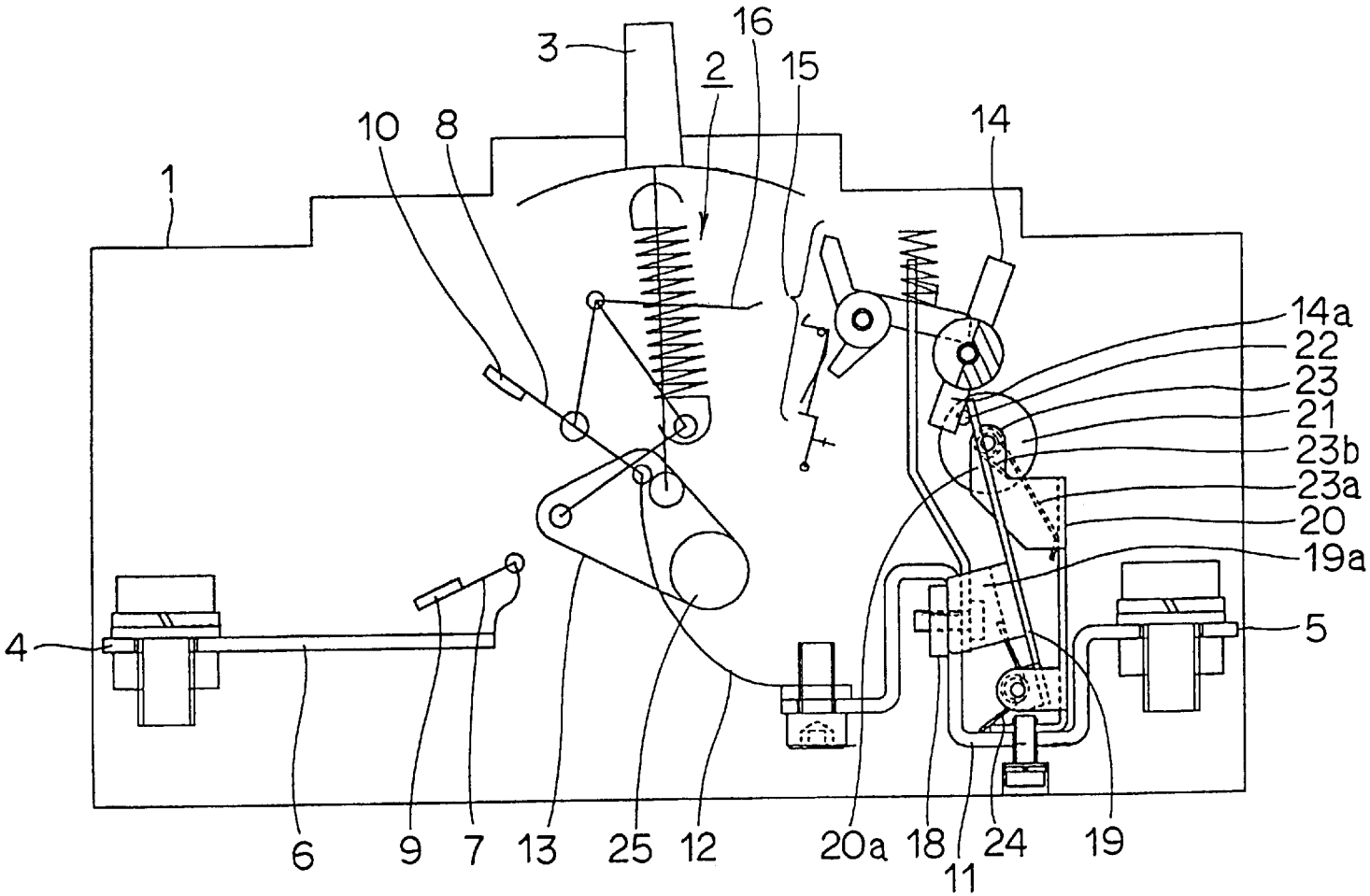

By a clockwise rotation of handle 3, operating mechanism 2 in FIG. 1 rotates a contact holder 13 holding movable contact 8 clockwise about a holder axis 25, so that switching contacts 9 and 10 are separated. Further, as discussed below, when the trip device operates, a trip shaft 14 biased anti-clockwise by a spring (not shown) rotates clockwise, a trip latch mechanism 15 operates, and a trip lever 16 rotates anti-clockwise, so that operating mechanism 2 operates to open switching contacts 9 and 10 as shown in FIG. 4. It is noted that the opened switching contacts can be brought into contact again by manipulating handle 3.

The trip device which rotates trip shaft 14 is provided with a thermally operating component or a magnetically operating component. As the thermally operating component, a bimetal 17 is bent in right direction about the inverted U-shape bent portion of trip conductor 11 by Joule heat greater than a predetermined value generated at trip conductor 11 when overcurrent flows, and the tip of bimetal 17 pushes trip shaft 14 to rotate it clockwise. The thermally operating component is not essential to the present invention.

The magnetically operating component includes an electromagnet having a stationary core 18, a movable core 19 pivotably supported on a frame 20, and a setting spring 24 which biases movable core 19 clockwise. An attract portion 19*a* which has an angular U-shape in the plan view of FIG. 1 is provided to movable core 19. Trip conductor 11 is surrounded by attract portion 19*a* and stationary core 18.

An inertia roller 21 is rotatably attached to an inertia roller holding arm 20*a* located at the top of frame 20. An operating spring 23 formed of a torsion spring is placed around the axis of rotation of the inertia roller. One arm 23*b* of operating spring 23 is in contact with inertia roller holding arm 20*a*, and the other arm 23*a* is in contact with the upright portion of the frame.

Inertia roller 21 is biased clockwise by a returning spring (not shown). Contact of an operating pin 22 attached to inertia roller 21 with the other arm 23*a* of the operating spring prevents a clockwise rotation of inertia roller 21.

An operation of the electromagnetic repulsion type circuit breaker employed as a main circuit breaker having the trip device of the embodiment of the invention is described below.

Figure 2:
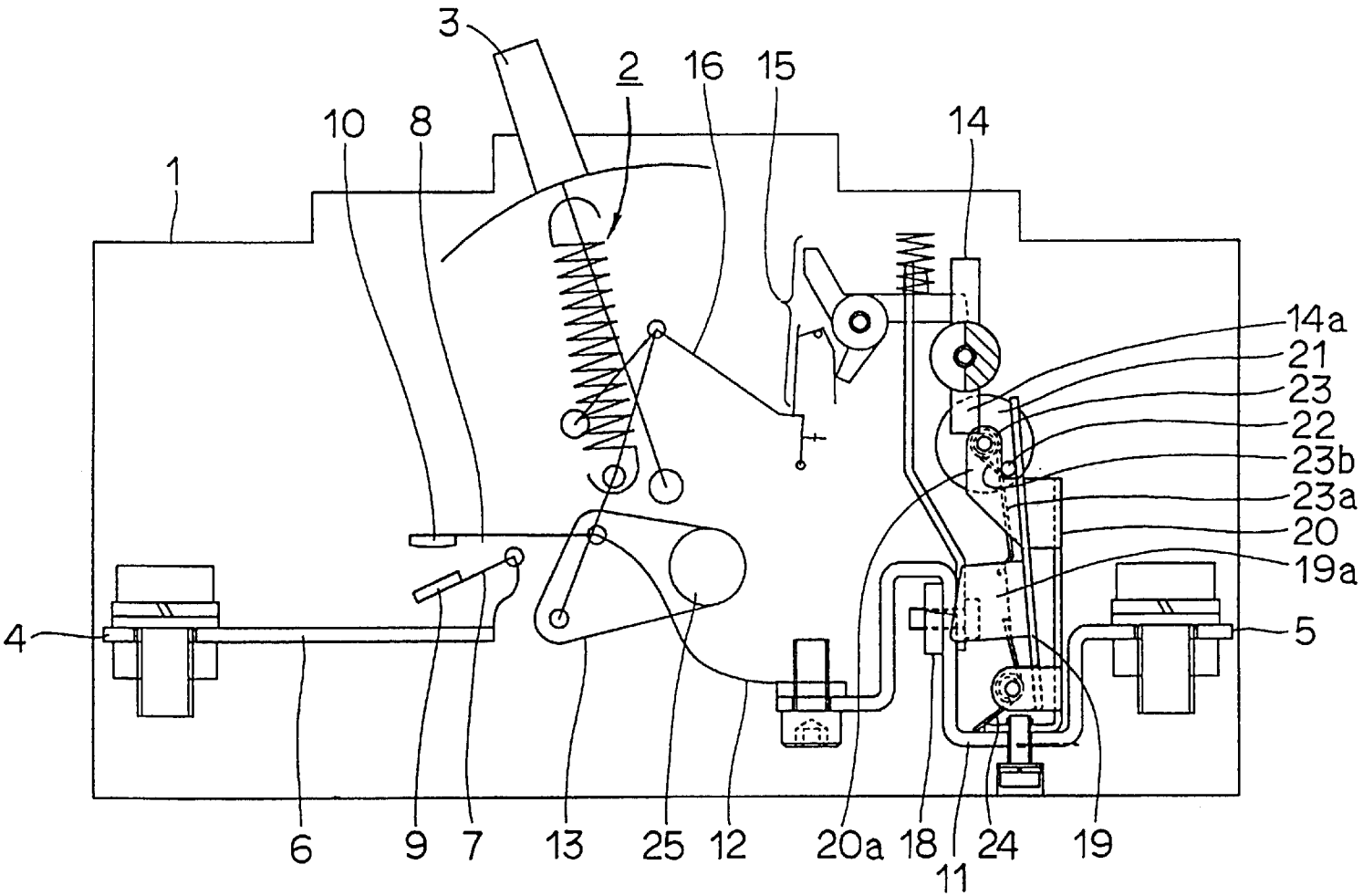
FIGS. 2 to 4 each illustrate an operation of the trip device of the circuit breaker according to the embodiment of the invention.

When the circuit breaker is in the state shown in FIG. 1 in which attract portion 19*a* of movable core 19 is separated from stationary core 18, if a short circuit happens to a load of a branch circuit breaker to cause an enormous alternating current to flow through the circuit breaker, attract portion 19*a* is attracted to stationary core 18 by the magnetic flux generated when an instantaneous value of the current exceeds a predetermined threshold. As a result, movable core 19 rotates anticlockwise. During the anti-clockwise rotation, the end of movable core 19 pushes operating pin 22, and operating pin 22 then pushes the other arm 23*a* to charge operating spring 23 with force while rotating inertia roller 21 clockwise. However, as shown in FIG. 2, operating pin 22 is brought into contact with inertia roller holding arm 20*a* before attract portion 19*a* of the movable core is attracted to touch stationary core 18. Rotation of inertia roller 21 is accordingly interrupted so that the end of movable core 19 does not push an operating arm 14*a* of trip shaft 14 and no rotation is caused. In other words, even if an abnormal current exceeds a threshold which causes the operation of the electromagnet, the trip device does not operate if the current exceeds the threshold for the first time. (The current which exceeds the threshold for the first time is hereinafter referred to as "FIRST PEAK.")

While the branch circuit breaker has components corresponding to movable core 19, setting spring 24 and stationary core 18, it is not provided with components corresponding to inertia roller 21, operating pin 22 and operating spring 23. Therefore, as soon as the abnormal current exceeds the threshold, it rotates a component corresponding to trip shaft 14 and the circuit breaker works its operating mechanism to break the abnormal current. The current never flows unless any operation is performed to cause the closed state.

The threshold of the operation of the trip devices in the main circuit breaker and the branch circuit breaker is determined by the size of the gap between attract portion 19*a* of the movable core and stationary core 18, and a spring force of setting spring 24 and the like. The threshold of the main circuit breaker is made greater than the threshold of the branch circuit breaker. Therefore, if current flows which causes movable core 19 to be attracted to stationary core 18 in the main circuit breaker, the trip device of the branch circuit breaker always operates.

Description given below concerns a case in which an accident such as short circuit occurs between a main circuit breaker and a branch circuit breaker, specifically at point X1 in FIG. 7.

Figure 3:
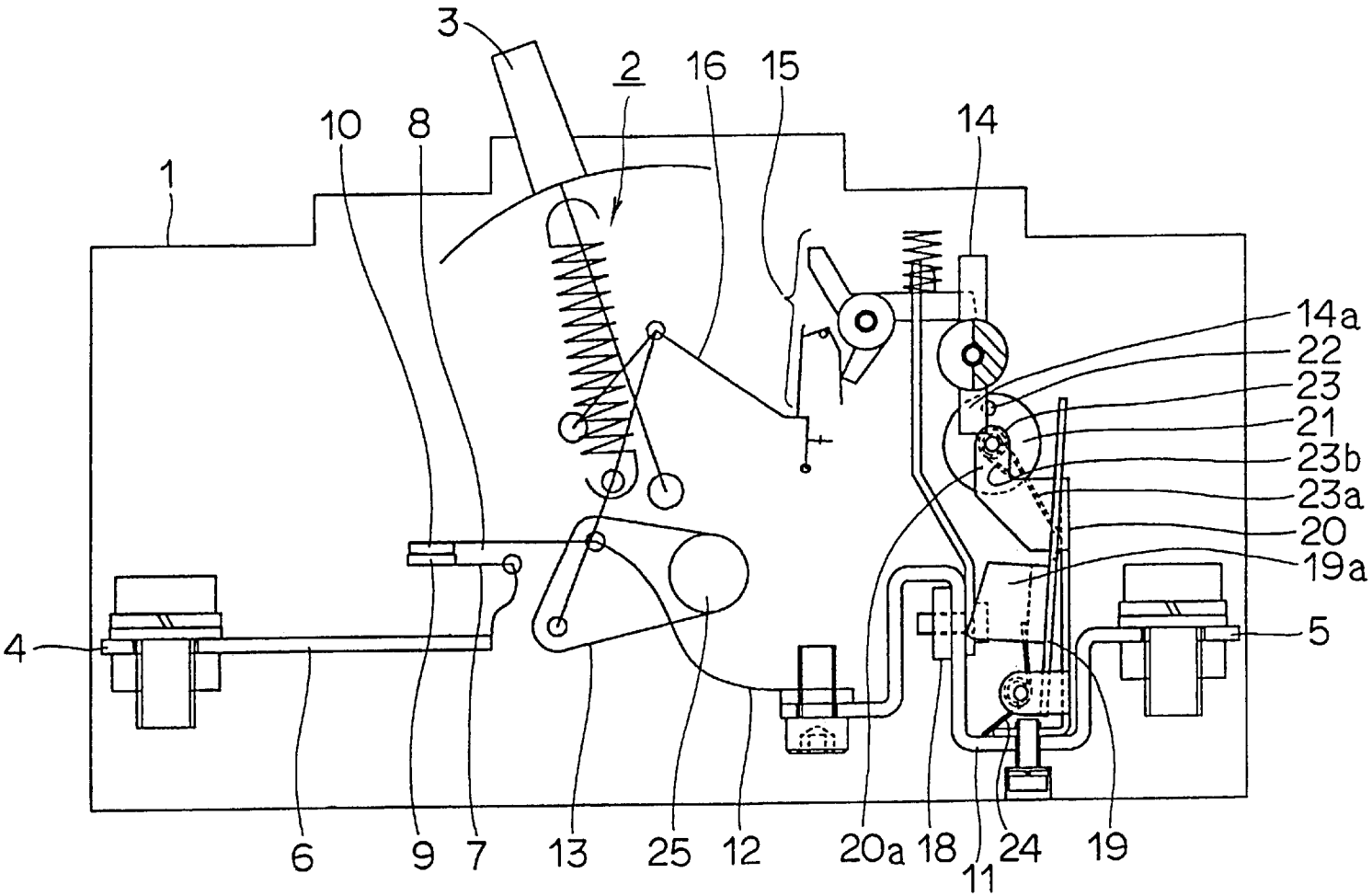

FIRST PEAK allows the trip device to operate as shown in FIGS. 1 and 2 explained above. However, electromagnetic repulsion opens the switching contacts and accordingly the electric current immediately falls to or approaches 0. The attracting force thus decreases and the acting force of setting spring 24 and the force discharged from operating spring 23 rotate movable core 19 clockwise to return it. When operating spring 23 discharges force, the other arm 23*a* "kicks" operating pin 22 as shown in FIG. 3 to rotate inertia roller 21 anti-clockwise. After this rotating force and the acting force of the return spring of inertia roller 21 become equal to each other, inertia roller 21 rotates clockwise to return.

Before inertia roller 21 returns to the state shown in FIG. 1, repulsion contact 7 which repelled and rotated then rotates clockwise to return since the current falls to or approaches 0 and the repulsion force accordingly decreases. As a result, switching contacts 9 and 10 are again brought into contact with each other. Suppose that the re-contact causes an abnormal current exceeding the threshold to flow again, and movable core 19 is attracted to stationary core 18 to rotate anti-clockwise. When the abnormal current exceeding the threshold flows two times with a slight time interval (the current exceeding the threshold for the second time is hereinafter referred to as SECOND PEAK), operating pin 22 does not return to a position which prevents rotation of movable core 19. Therefore, the end of movable core 19 pushes operating arm 14*a* of the trip shaft and rotates it.

Figure 5:
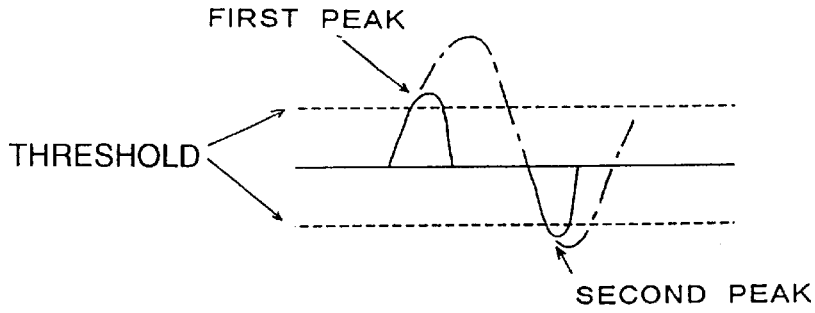
FIG. 5 is a waveform chart illustrating the current flowing through the circuit breaker when the trip device of the circuit breaker operates as shown in FIGS. 2 to 4.

Consequently, although the electromagnetic repulsion force opens switching contacts 9 and 10 and accordingly the abnormal current is broken as shown in FIG. 4, operating mechanism 2 is also operated by the operation of the trip device of the invention. Therefore, the current never flows again unless handle 3 is manipulated to close the circuit again. The waveform of the current flowing through the electromagnetic repulsion type circuit breaker is shown in FIG. 5. If the current exceeding the threshold flows two times with a short interval, the trip device does not operate at FIRST PEAK, but the trip device operates at SECOND PEAK without fail to release trip latch 15. The alternate long and short dash line in this chart represents an abnormal current which is not broken. The waveform drawn by the solid line represents current which is broken to be decreased owing to the effect of opening of the repulsion contact as well as that of the trip device.

In order to avoid rotation of inertia roller 21 to return to the state shown in FIG. 1 before SECOND PEAK flows, inertia roller 21 is formed of material having its weight which is enough to provide inertia, specifically material having a certain inertia moment or more. However, another method may be applied such as escapement mechanism if the returning rotation can be delayed.

The trip device of this embodiment can display the selective tripping function even if the device is applied to a main circuit breaker which is not the electromagnetic repulsion type. Specifically, if short circuit happens to the load of the branch circuit breaker, the trip device of the main circuit breaker does not operate upon occurrence of FIRST PEAK current. Instead, the trip device of the branch circuit breaker operates to break the short-circuit current.

Figure 6:
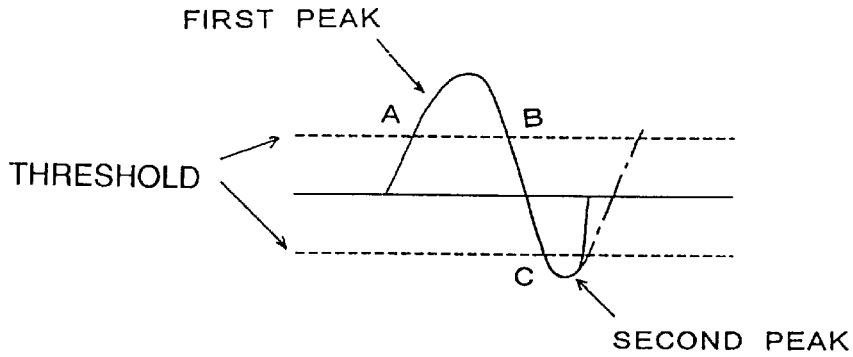
FIG. 6 is a waveform chart illustrating the current flowing through a circuit breaker which is not the electromagnetic repulsion type having the trip device in the embodiment of the invention applied thereto.
Figure 7:
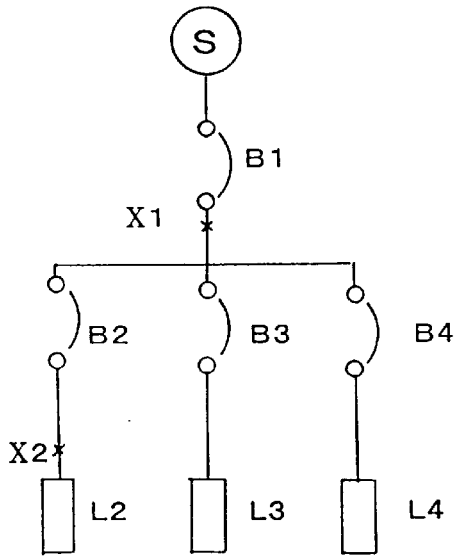
FIG. 7 is a general electric circuit diagram where circuit breakers are connected.

Description is next given on a case in which an accident occurs between a non-electromagnetic repulsion type main circuit breaker and a branch circuit breaker, specifically at point X1 in FIG. 7. The waveform of the current flowing in this case through the main circuit breaker is shown in FIG. 6. When FIRST PEAK current flows, movable core 19 is attracted to stationary core 18 at the time represented by A. However, rotation of the movable core 19 is prevented by operating pin 22, and movable core 19 rotates clockwise to return at the time represented by B at which the current falls below the threshold. As a result, operating spring 23 "kicks" operating pin 22 to rotate inertia roller 21. On the other hand, before the current increases again to exceed the threshold at the time represented by C, inertia roller 21 does not rotate to return by the inertial moment to the position which allows operating pin 22 to engage with movable core 19. Therefore, when SECOND PEAK flows at time C, movable core 19 is not interrupted by operating pin 22, and attracted to touch stationary core 18 and release trip latch 15. In this circuit breaker, the current does not fall to 0 between FIRST PEAK and SECOND PEAK. However, the operating mechanism operates as in the electromagnetic repulsion type circuit breaker to open the circuit.

If the trip device of this embodiment is applied to the electromagnetic repulsion type circuit breaker, the selective tripping function is exercised upon occurrence of an accident at the load of the branch circuit breaker. In addition, if an accident happens to the load of the branch circuit breaker, the contacts of the main circuit breaker and the contacts of the branch circuit breaker are almost simultaneously opened. Therefore, an additional effect is obtained to break a greater abnormal current by the breakers in cooperation with each other.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A trip device of a circuit breaker having an operating mechanism for closing and opening switching contacts, and a trip latch working said operating mechanism when released to open said switching contacts, said trip device comprising a stationary core and a movable core which is attracted to said stationary core when current flowing through a circuit exceeds a predetermined threshold to release said trip latch, and said trip device further comprising:

an operating member having engagement means for engagement with said movable core and moving via said engagement means when said movable core is attracted;

stopper means for interrupting movement of said operating member while said movable core is attracted so as to prevent release of said trip latch;

an operating spring charged with force when said movable core is attracted and discharging the force when said movable core returns so as to move said operating member by the discharged force; and a returning spring biasing said operating member which is moved when said operating spring discharges the force in a direction toward its original position, wherein said operating spring discharges the force when the current flowing through said circuit decreases and said operating member with its movement interrupted by said stopper means by the discharged force moves to a position which does not allow said movable core attracted again when said current again exceeds said threshold to engage with said engagement means.

2. The trip device of the circuit breaker according to claim 1, wherein said operating member is a roller pivotably supported and having an inertial moment.

3. The trip device of the circuit breaker according to claim 2, wherein said engagement means is a pin eccentrically placed at said roller.

4. The trip device of the circuit breaker according to claim 1, wherein said movable core is shaped as a hinge and an operation setting spring for biasing said movable core in a direction away from said stationary core is provided.

5. The trip device of the circuit breaker according to claim 1, wherein said circuit breaker is of an electromagnetic repulsion type which causes said switching contacts to repel with each other by an electromagnetic force generated by current flowing through said switching contacts and causes said switching contacts to be brought into contact again due to vanishing or reduction of said electromagnetic force.

* * * * *